United States Patent [19]

Hoorn

[11] Patent Number: 4,482,146

[45] Date of Patent: Nov. 13, 1984

[54] DISPENSER OF SINGLE FILM SHEETS

[75] Inventor: Willem A. Hoorn, Amersfoort, Netherlands

[73] Assignee: E. I. Du Pont de Nemours and Company, Wilmington, Del.

[21] Appl. No.: 444,088

[22] Filed: Nov. 24, 1982

[51] Int. Cl.[3] ..... B65H 3/06; B65H 3/56

[52] U.S. Cl. ..... 271/127; 271/22; 271/149; 271/160; 271/161

[58] Field of Search ..... 271/21, 22, 23, 24, 271/25, 119, 127, 145, 149, 160, 161, 162, 165, 167, 118; 221/231, 261; 414/330; 53/266 C

[56] References Cited

U.S. PATENT DOCUMENTS

| | | | |
|---|---|---|---|
| 3,743,276 | 7/1973 | van der Does | 271/24 |
| 3,955,092 | 5/1976 | Hubert | 271/131 |
| 3,959,654 | 5/1975 | Stievenart et al. | 53/266 C |
| 4,004,795 | 1/1977 | Agnew et al. | 271/149 |
| 4,136,861 | 1/1979 | Goff, Jr. | 271/22 |
| 4,227,687 | 10/1980 | Schoonmade | 271/139 |
| 4,253,653 | 3/1981 | Bauer | 271/22 |
| 4,362,296 | 12/1982 | Schmidt | 271/149 |

FOREIGN PATENT DOCUMENTS

| | | | |
|---|---|---|---|
| 664671 | 6/1963 | Canada | 271/160 |
| 2247526 | 7/1974 | Fed. Rep. of Germany . | |
| 2329927 | 1/1975 | Fed. Rep. of Germany | 271/22 |

*Primary Examiner*—Duane A. Reger
*Assistant Examiner*—James E. Barlow

[57] ABSTRACT

An apparatus is provided for separating and dispensing a single film sheet from a stack of the sheets.

15 Claims, 13 Drawing Figures

28
9
20
23
25
34
35
16
18
15
19
53
14
48
16
18
56
13
102
46
54
100
47
55
150
151

206
210
212
22
200
34
13
205
36
204
38
202
208
17
35
40

20
23
25
34
8
35
13
16
15
44
19
150
53
14
51
48
19
16
56
114
18
112
151
102
106
46
100
47
55
54

DISPENSER OF SINGLE FILM SHEETS

FIELD OF THE INVENTION

This invention pertains to film sheet dispensers and, more particularly, to an apparatus for separating and dispensing a single film sheet from a stack of such sheets.

DESCRIPTION OF THE PRIOR ART

Single sheet dispensers that separate and dispense a single sheet from a stack of such sheets are well known in the art. Such apparatus may be broadly if somewhat arbitrarily classified into apparatus for dispensing sheets having smooth surfaces and all others. This division is acceptable since the problems of separating and dispensing sheets having smooth surfaces from a stack of such sheets are different from the problems encountered in separating other sheets as, for example, cardboard cards such as IBM computer-type punched cards. The major problem encountered when smooth-surfaced sheets, such as photographic film sheets, are stacked together, is that air is excluded from between the sheets due to the good contact between the smooth surfaces, and the film sheets resist separation.

This problem is further compounded when the film sheets comprise photosensitive sheets, such as a stack of medical X-ray film sheets. It is known that in the process of separating a single sheet from the stack, care must be exercised not to damage the photosensitive layer either by scratching, through the application of localized high pressure, or by sharply bending the film; these activities tend to produce undesirable markings on the film after development.

While apparatus for dispensing film sheets such as described above is known in the art, such apparatus is complex and often unreliable. There is thus still need for dispensing apparatus which exhibits a high degree of reliability in consistently separating and dispensing one sheet at a time from a stack.

BRIEF SUMMARY OF THE INVENTION

This and other problems are solved by the instant invention, through an apparatus for separating and dispensing a single film sheet from a stack of film sheets loaded therein in a substantially vertical position and which comprises:

(1) a casing;

(2) a film stack holding means within such casing for holding a stack of generally rectangular film sheets in a substantially vertical position, including;

(a) a pressure plate pressing against one side of said stack along two narrow bands, extending across the upper and lower ends thereof;

(b) a pivotally mounted base plate supporting the opposite side of said stack and spaced from said pressure plate, having an upper end hingedly mounted in said casing so as to permit the base plate to swing out from the stack; and associated actuating means mounted on the base plate and the casing for urging the lower part of the base plate to swing alternately toward and away from the pressure plate;

(c) film stack support means defining an inclined plane located below and extending between said pressure plate and said base plate for supporting said film stack along one lower edge thereof between said pressure and base plates:

(d) roller means extending through said base plate which function to provide film support points along an upper end of said film stack, whereby a space is maintained between the upper end of said film stack and said base plate;

(e) at least one elongated combination film stack retainer and film separator cam pivotedly mounted on said stack support means; and (f) spring means connected to said cam and stack support means urging an inner surface of said cam in contact with an outermost sheet of said film stack, whereby a film stack placed in said film stack holding means will assume a slightly curved shape, curving away from the base plate when the base plate is positioned generally parallel to the pressure plate;

(3) an upper film separator mounted within said casing at a point adjacent the upper edge of said stack, including a slot located substantially in line with the aforesaid outermost film sheet of the film stack, sized to allow one, but not two, film sheets to be inserted therein simultaneously;

(4) at least one driven, rotatable, reversible, resilient first cam wheel mounted in said casing and extending through the base plate, positioned so as to intermittently contact the aforesaid outermost film sheet at a point near the upper edge thereof, and means for selectively driving said first cam wheel; whereby when the cam wheel is driven through an arc clockwise it pushes said outermost film sheet into the slot in the upper film separator; and (5) a pair of drive wheels located in said casing below the film stack support means and forming a nip at a point below and behind the separator cam, and associated drive means for selectively driving said drive wheels; whereby when the cam wheel is rotated through an arc counterclockwise it pushes the aforesaid outermost sheet into the nip of the drive wheels, thereby separating said outermost film sheet from the film stack and dispensing it.

BRIEF DESCRIPTION OF THE DRAWINGS

The invention will best be understood and explained with the use of the following figures, which form an integral part of this specification and in which.

DETAILED DESCRIPTION OF THE INVENTION

This invention will now be described with reference to the drawings in which the same numerals refer to the same elements in all figures.

Figure 1:
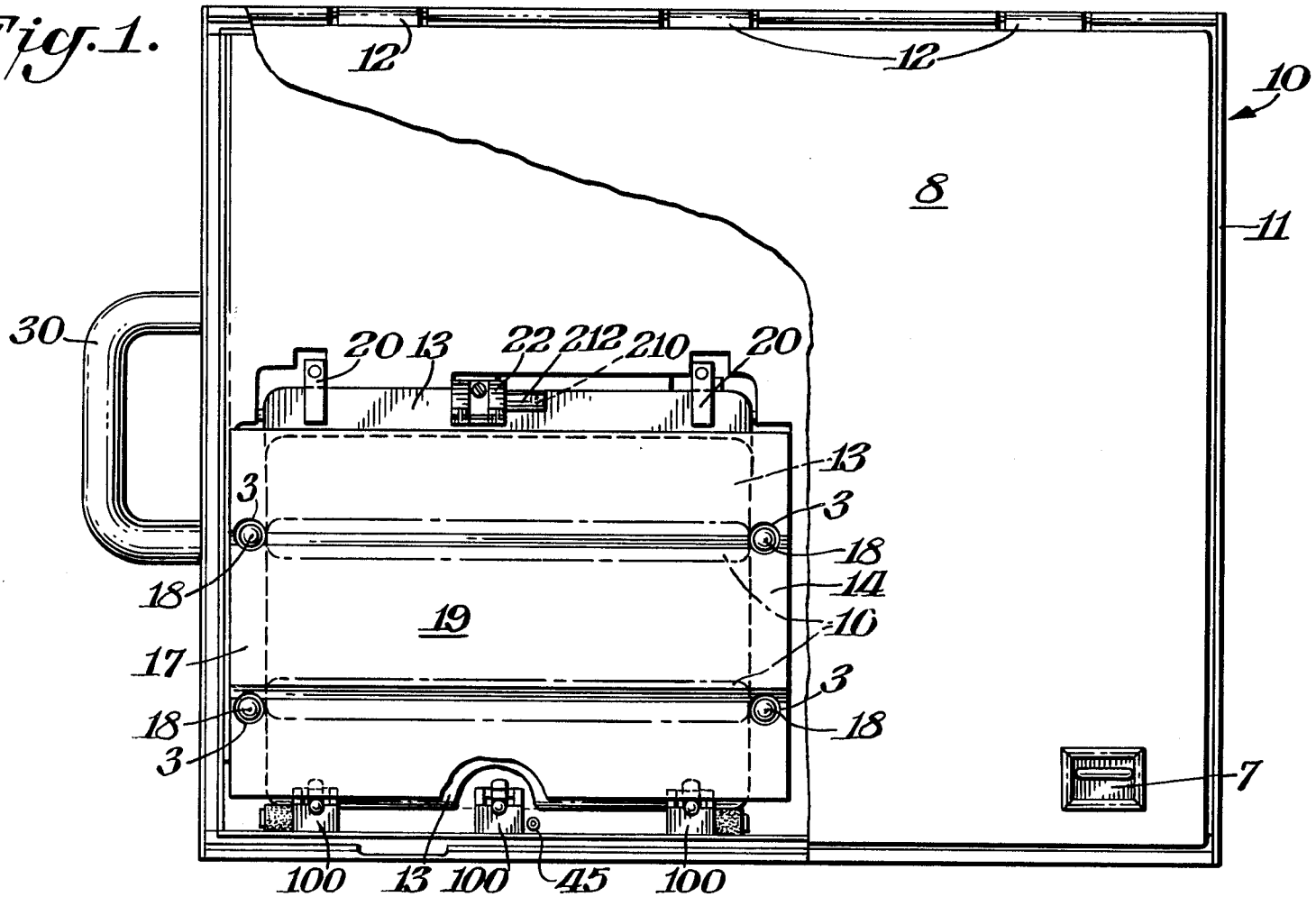
FIG. 1 illustrates in broken top view a universal size casing containing a mechanism in accordance with the present invention for dispensing film sheet of a given size.

With reference to FIG. 1, a casing 10 having a rectangular frame 11 is provided with a cover 8 hinged at one end through hinges 12. A latch 7 allows opening and closing of cover 8 to provide operator access to the interior space of casing 10 for loading a stack of film sheets 13 in an appropriate receiving area to be described below. As shown in FIG. 1, the casing may be of substantially larger size than the size of the film sheets to be dispensed, and the dispensing mechanism may occupy only a portion of the available space.

It is often desirable to employ such single film sheet dispensers in conjunction with apparatus which automatically loads film holding devices of various sizes with appropriately sized film sheets. It is thus desirable to provide a universal size casing for holding a supply of predetermined size films for use with such apparatus; such casings are sized to hold the largest film sheet anticipated to be loaded in a cassette. All other casings holding smaller size film sheets would have similar outer dimensions so that the equipment may be readily standardized. An apparatus useful in loading medical X-ray film sheets into cassettes of variable sizes, employing the separator and dispenser of this invention, is described in my copending application PD-1974.

Figure 3:
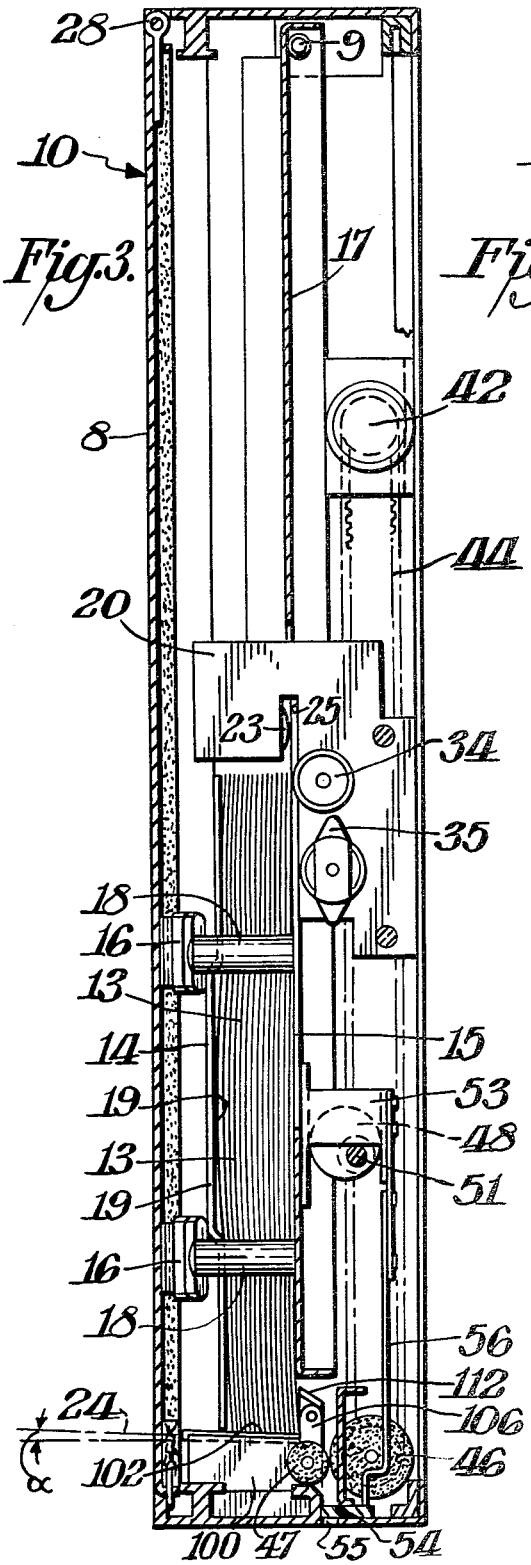
FIG. 3 represents a cross sectional view taken along lines 3—3 of FIG. 2 with the various operative elements of the apparatus in the "stand by" position.

Referring to FIGS. 1 and 3, a base plate 17 is shown mounted within said casing 10. This base plate is hingedly mounted through hinge 9 at the upper portion of the casing 10 and includes a cutaway portion 15. On this base plate 17 are mounted 4 (four) posts 18 spaced from each other to define a rectangular area sized to allow the insertion therein of a film stack 13. This limits the lateral movement of the film stack to the space enclosed by the posts 18.

Figure 10A:
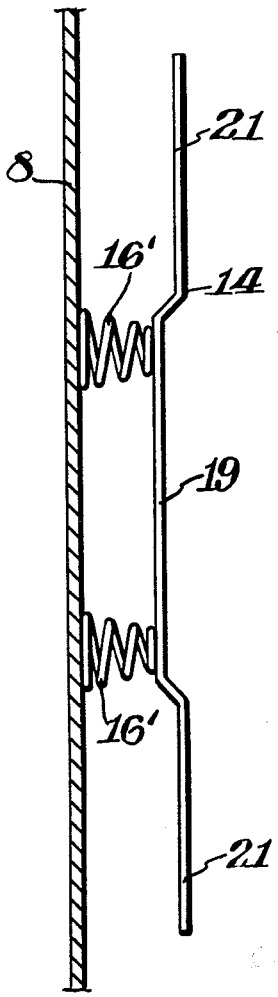
FIG. 10A is an elevational view illustrating an alternate spacing arrangement for biasing the pressure plate illustrated in FIGS. 10 and 11.
Figure 10:
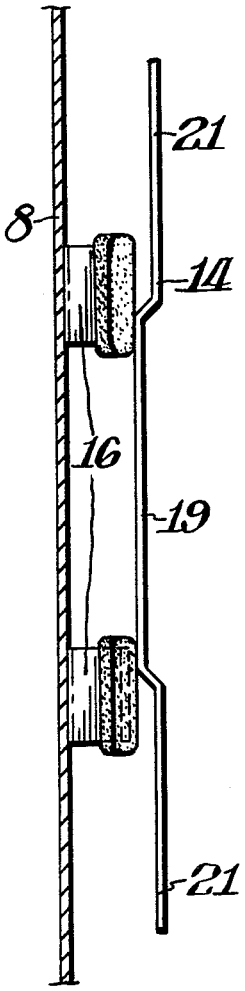
FIG. 10 is an elevational view illustrating the pressure plate assembly of this invention.
Figure 11:
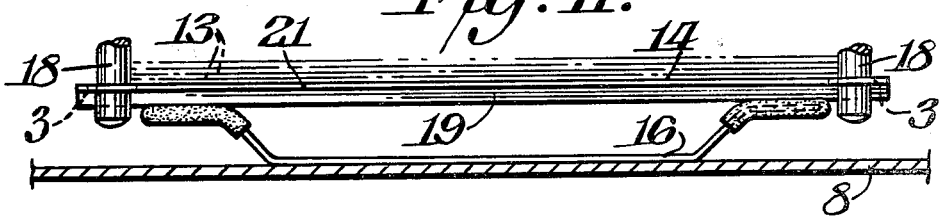
FIG. 11 is a top plan view of the assembly of FIG. 10 showing a leaf spring biasing arrangement.

A pressure plate 14 shown in greater detail in FIGS. 10 and 11 is seated over the film stack 13. This plate is not permanently attached to the casing but is removable. The pressure plate comprises 4 alignment holes which correspond to the four posts 18 and maintain the plate in its proper position, and orientation. The plate is preferably shaped with a recessed portion 19 so that when placed over the film stack it contacts the outermost sheet along two narrow bands extending across the upper and lower ends of the film through ledges 21. It is also preferred to provide the surface in contact with the film stack with a coating, such as a vinyl coating or other material, to reduce film friction or the possibility of film surface damage. Two leaf springs 16 are mounted on the pressure plate 14 on the side normally facing away from the film stack. When cover 8 is closed, the leaf springs abut thereon, applying pressure to the film stack 13 and biasing it toward base plate 17. In an alternate embodiment, shown in FIG. 10A, the leaf springs are replaced by conical springs 16' to provide the necessary biasing pressure.

Figure 8:
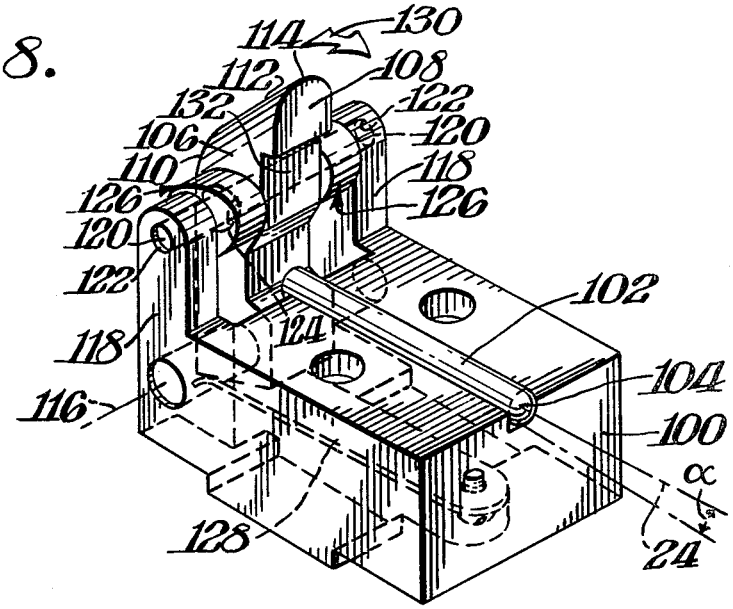
FIG. 8 is a perspective view of the lower film retainer and separator mechanism.

At the lower end of the casing 10 a film stack support means comprising a set of blocks 100 supports stack 13. As seen in FIG. 1, blocks 100 are mounted on the frame 11 in the lower part of the casing by conventional means. As illustrated in greater detail in FIGS. 8 and 9, the support element in each block is a protruding rod 102 mounted in a channel 104. The axis of this rod 102 forms a small angle $\alpha$ with the horizontal plane when the three blocks are mounted in parallel on the frame 11 and the casing is placed in its operative position. In such position these rods 102 provide a tilt support for film stack 13.

Mounted on each block 100 and extending perpendicularly therefrom is a lower film stack retainer/ separator in the form of an elongated separator cam 106 having an inner surface 108 and an outer surface 110 generally parallel to each other and connected by a bezel 112, i.e., a curved, inclined surface terminating in a sharp edge or tip 114. It is desirable that the angle theta formed by the bezel 112 and the inner surface 108 plane be acute, and preferably not larger than 65°. Similarly, it is preferred that edge 114 be not thicker than ¼ of the thickness of an individual film sheet. This will prevent an exiting sheet from catching on the edge and lifting the cam 106, thus jamming the film sheet in the machine. The curvature of the ridge of the bezel 112 serves to prevent scratching of the film sheet.

Separator cam 106 is pivotably mounted along an axis 116 passing at a point near one end of said cam. Block 100 further comprises two upright supports 118 extending in the direction of outer cam surface 110, and having apertures 122 through which extends a pin or shaft 120. Cam 106 also has an aperture 124 through which passes pin 120; however, this aperture is larger than the pin diameter. Two circular spacers 126 are placed between uprights 118 and cam 106 to prevent the latter from lateral shifting. A leaf spring 128 urges cam 106 in the direction of arrow 130. However, the amount of displacement of the cam is limited by the size of the aperture 124.

Figure 9:
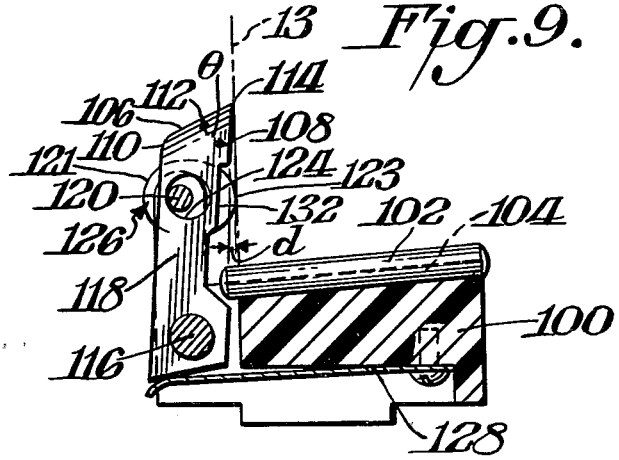
FIG. 9 is a longitudinal cross-sectional view taken through FIG. 8.

The function of the spacers is twofold. As shown in FIG. 9 the spacers 126 are sized to protrude slightly from either side of cam 106. The protruding portion 121 serves as a guide for an exiting film sheet, reducing surface contact with the cam surface and minimizing the possibility of film scratches. The inner protruding portion 123 extends past the plane of surface 108 by a small distance "d". This offset "d" forces a film sheet stack placed on rod 102 to preferably contact surface 108 near the edge 114, thus assuring that there will be no gap at that point between a retained film stack and sharp edge 114 into which the leading edge of an exiting film sheet might enter, jamming the machine.

Cam 106 further comprises a recess 132, whereby when a stack of film is placed on the film stack support means it will be supported on rods 102 and retained by a small portion of inner surface 108 of cam 106.

Referring back now to FIG. 3, there is further provided an idler roller 34 which extends through opening 15 in base plate 17. Idler roller 34 is mounted on a block 20 at a point near the upper end of film stack 13; block 20 cooperates with plane 24, cam 106, and posts 18 to define a space sized to accept a given size film stack 13. When such a stack is placed in this space, and the casing is in its operative position, the film stack 13 acquires a slightly curved posture, leaning against ledges 21 and supported at an angle along its bottom, held away from the base plate by separator cam 106 and idler roller 34. Thus, the film stack is held in place by forces which are not applied along its full surface, but at a few points, minimizing any tendency to compact the sheets and aggravate the separation problem.

Figure 2:
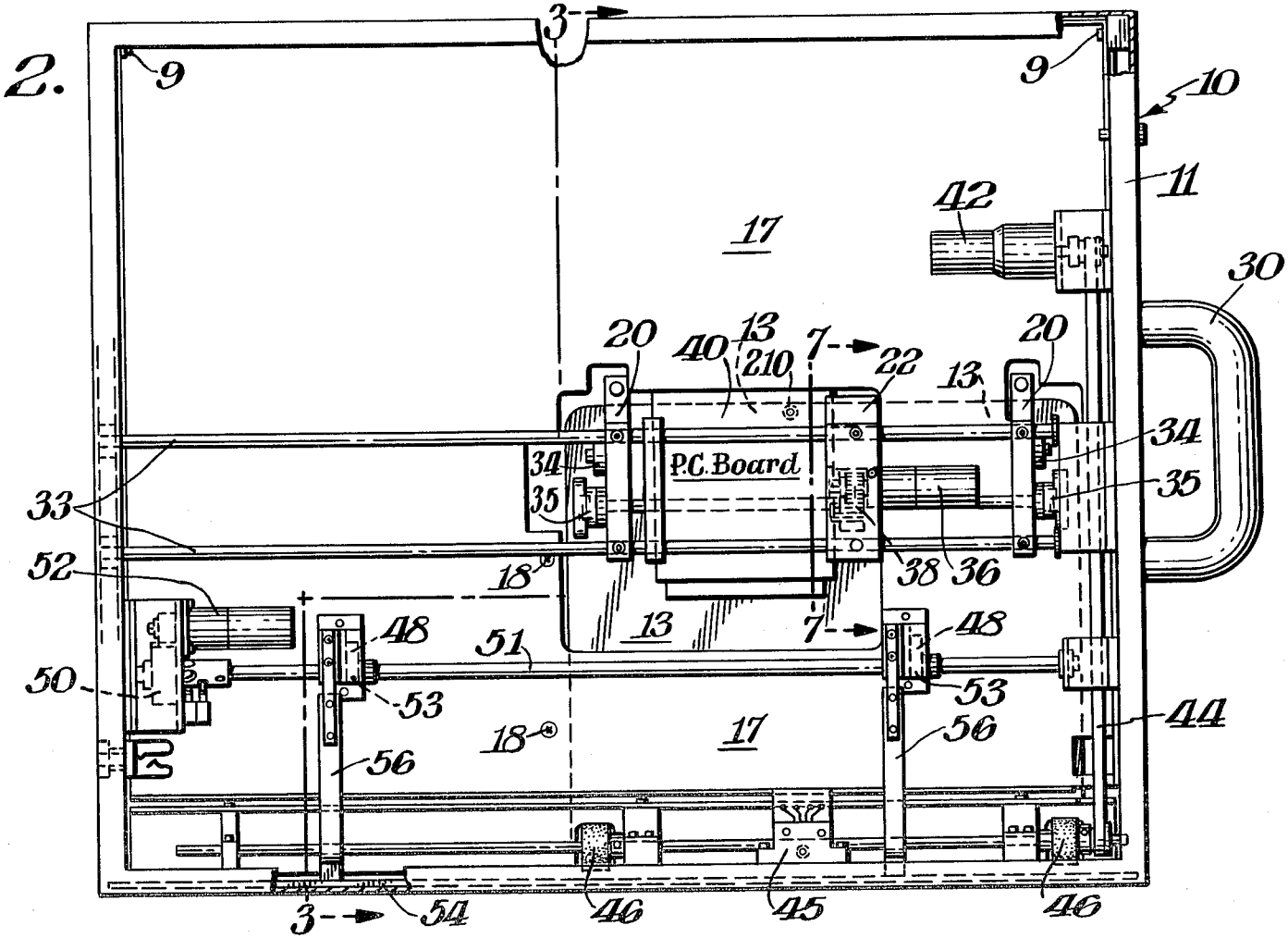
FIG. 2 illustrates a bottom view of the mechanism of FIG. 1.
Figure 4:
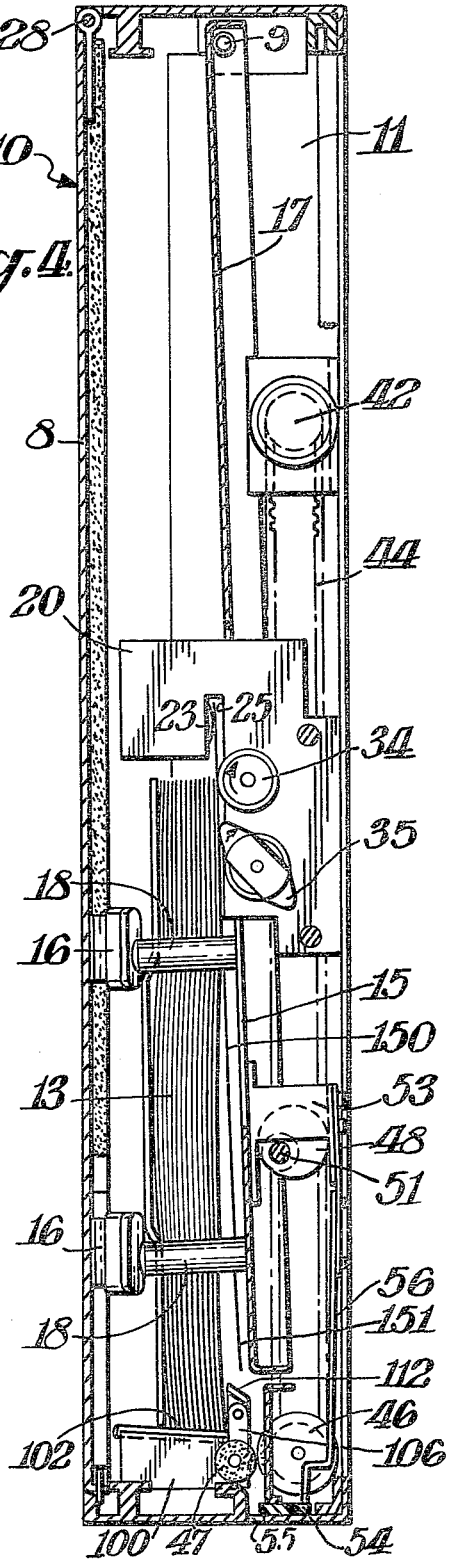
FIG. 4 is the same representation as in FIG. 3, with the operative elements in the film separating position.

As shown in FIGS. 1 and 2 there are two blocks 20 arranged in parallel, and supported by shaft 33; FIG. 3 shows these to be positioned near the upper end of the film stack to be placed in the casing. Blocks 20 serve the dual function of supporting a film drive mechanism and providing film guide path slots 25 to contain an outer film sheet 150 removed from the stack as shown in FIG. 4. Within each slot 25 is a spring clip 23 which tends to hold in place a film sheet which has been pushed into the slot, thus preventing its accidental release due to gravity.

Referring to FIG. 2, a printed circuit board 40 supported behind base plate 17 contains control circuitry for driving motors 36, 42 and 52.

Through a gear arrangement, motor 36 drives a resilient cam wheel 35 which is shaped in a generally eliptical form and is so mounted that as it rotates it extends through opening 15 in base plate 17 to intermittently contact the film stack. Preferably two such wheels are used, as illustrated in FIG. 2, so as to contact the film stack at two points near its upper end, just below idler roller 34. Motor 36 is reversible so that cam wheel 35 may be selectively rotated either clockwise or counterclockwise.

Figure 7:
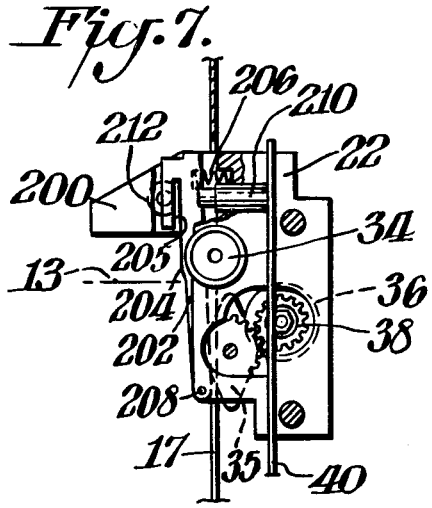
FIG. 7 is a cross-sectional view showing a detail of the upper film separator mechanism, taken along line 7—7 of FIG. 2.
Figure 5:
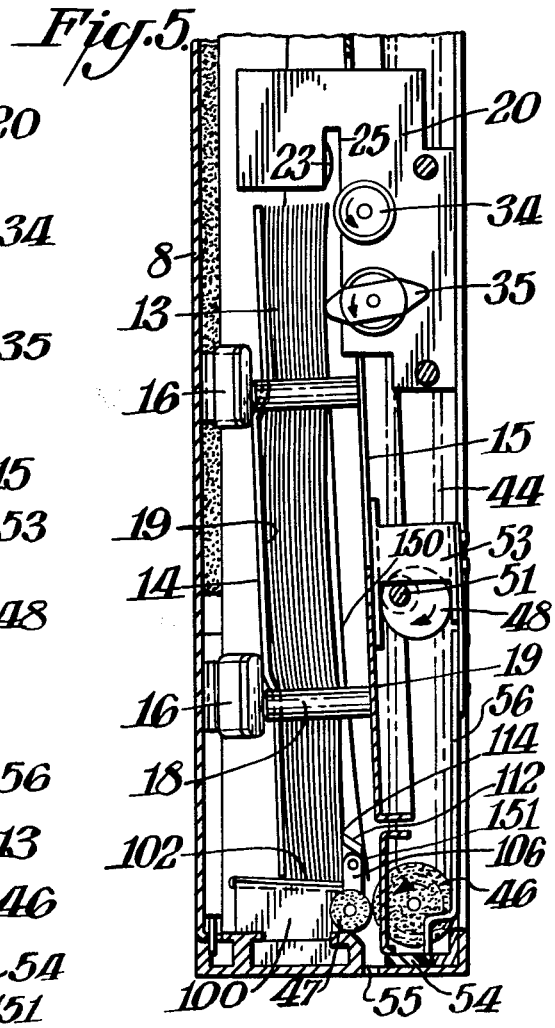
FIG. 5 is the same representation as in FIG. 3 showing a separated film sheet in its path toward the dispensing mechanism.
Figure 7A:
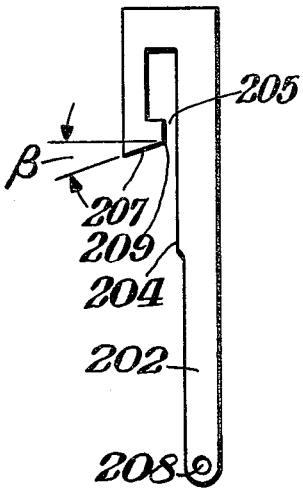
FIG. 7A shows a detail of the upper film separator slot of FIG. 7.

Also mounted above the upper edge of the film stack at a point preferably equidistant from the two blocks 20 is upper film separator 22 (FIG. 2). As shown in greater detail in FIG. 7, film separator 22 comprises a block 200, arm 202, the operative surface of which (204) functions as a film guide surface terminating in a fish hook-shaped bend, the mouth of which bend forms a separator slot 205. As illustrated in greater detail in FIG. 7A, separator slot 205 is defined by surface 204 and forward edge 207, and is so dimensioned as to permit only one film sheet at a time to be pushed through it, not two. Edge 207 is beveled at an angle $\beta$ of about 15° relative to a line perpendicular to the slot, and terminates in a sharp corner 209 at the slot entry. This beveled edge is needed to catch the leading edge of a film sheet as it is pushed into separator slot 205. When angle $\beta$ is 45° or more, and if two sheets are pushed simultaneously toward the separator slot, they could press together and jam the machine.

Arm 202 is pivotally mounted on block 200 at a point 208 and supported at the other end with a biasing spring 206. The action of the spring is such that arm 202 may move slightly up or down with respect to block 200 so as to facilitate the entry of a leading edge of a film sheet into separator slot 205. It is desirable that the width of the arm and slot be kept to a minimum and widths of $\frac{1}{4}$ to 1 inch are usually adequate. Also mounted on block 200 is a photodetector system, preferably an infrared radiation detector 212 and an infrared emitter 210, positioned to detect the presence of a film sheet in separator slot 205.

Referring back to FIGS. 2 and 3, motor 52, through gear arrangement 50, drives shaft 51 on which are mounted cam wheels 48. These wheels are partially enclosed in a housing 53 which is attached to the back side of base plate 17; as they rotate in the housing they alternately urge base plate 17 toward, and away from, film stack 13. Since plate 17 is hinged at one end, it moves angularly in response to the rotation of cam wheels 48.

At the lower portion of the casing, below the inclined plane level supporting the lower edge of the film stack, are mounted a pair of cooperating film drive rollers 46 and 47, defining a nip. Under the nip, frame 11 provides an opening 55 maintained in a normally closed position through a shutter 54, kept in normally closed position by the action of a pair of leaf springs 56. The leaf springs extend to a point adjacent cam wheels 48 and cooperate with the cam wheels to selectively open or close shutter 54. A motor 42 operates drive roller 46 through a timing belt 44. An infrared film detector 45 is also placed adjacent the shutter to detect the leading and lagging ends of an exiting film sheet.

In operation, a stack of film sheets of an appropriate size are placed in the casing while the casing is maintained on a convenient surface with the cover up and opened. The film stack thus initially rests on base plate 17, which is maintained in the stand-by mode through the action of cam wheels 48 and housing 53 as shown in FIG. 3. In that position, base plate 17 is substantially parallel to the casing cover plane. Next, the pressure plate 14 is positioned over the stack 13 and the cover closed, whereby the leaf springs 16 (FIG. 10), or conical springs 16' (FIG. 10A), apply pressure to the film stack.

The casing is now placed vertical to its edge with shutter 54 at the bottom. This is the operative position. The film stack 13 assumes its curved posture and the inclined plane further forces the individual sheets to slightly separate as their edges align thereon.

FIG. 4 illustrates what happens when a film sheet is separated from the stack. First, cam wheel 35 rotates in the direction of the arrow. This action imparts a vibration to the film stack which tends to release the forces holding individual sheets against each other. As the holding forces are released, cam wheel 35 drives the outermost film sheet 150 upwardly into slots 25 and along surface 204 of arm 202, into separator slot 205. Even if more than one film sheet starts upwardly because of drag only one will fit into separator slot 205. The distance traveled by that one film when its leading end reaches the end of its travel upwardly is such that the lagging end 151 just clears the tip 114 of separator cam 106. Simultaneously, cam wheels 48 rotate to swing the lower portion of base plate 17 away from the film stack. This allows the lagging end 151 of film sheet 150 to move away from the film stack, since it is held only near its upper end by the film clips 23 plus the pressure exerted by the film stack where it leans against roller 34. Shutter 54 has also swung back, uncovering opening 55.

When the detectors 210 and 212 determine that a film sheet has left the stack and gone into separator slot 205, the direction of rotation of motor 36 is reversed and cam wheel 35 operates to push film sheet 150 in an opposite direction, toward shutter 54. As the now leading edge 151 of the film sheet contacts the curved surface of bezel 112 of cam 106, it rides over it. Cam 106 is kept in intimate, albeit light, contact with the film stack, and the sharp edge 114 of bezel 112 does not allow the leading edge of a film sheet to enter under the cam. Meanwhile, motor 42 has been actuated and exit roller 46 is turning in the direction of the arrow. At the same time, base plate 17 has swung even further from the film stack, providing a completely clear path for the exiting film sheet.

Figure 6:
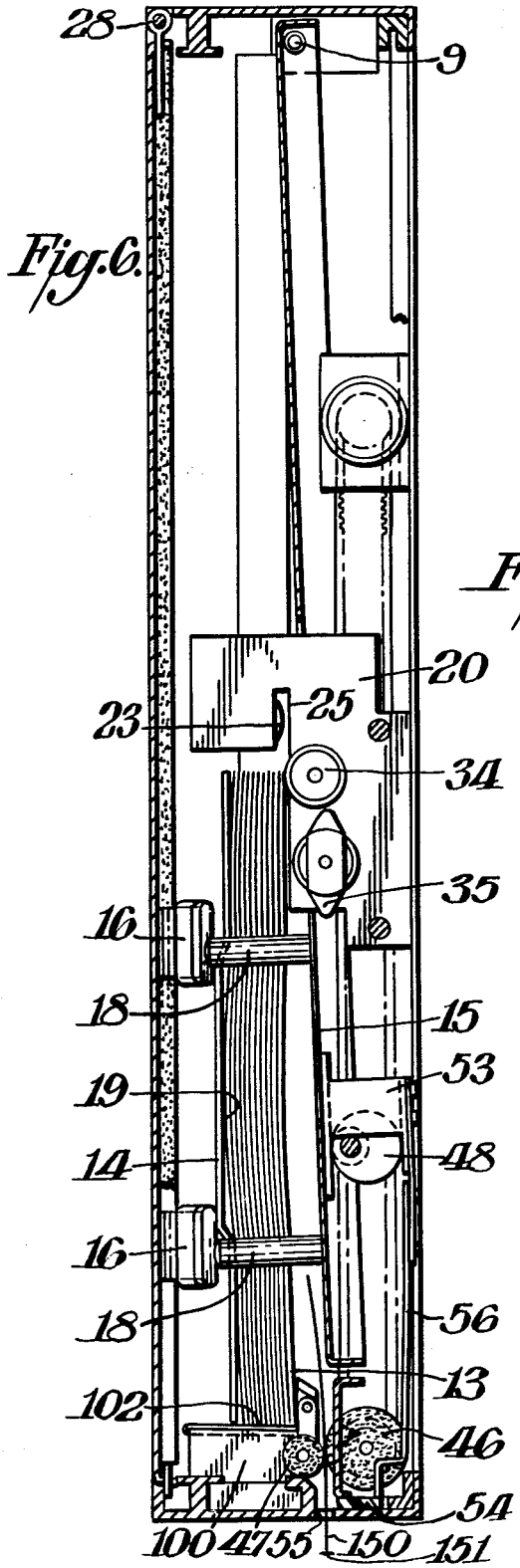
FIG. 6 is the same representation as in FIG. 3, showing a separated film sheet being dispensed.

In FIG. 6, the film sheet 150 has been essentially dispensed from the casing. As the leading edge 151 is detected by detector 45, the control circuitry stops motor 36 so that cam wheel 35 is out of contact with the exiting film sheet to prevent drag and possible surface damage. The film is now driven out of the casing by the cooperating action of rollers 46 and 47. When the film exits, detector 45 detects its lagging end and returns the system to the stand-by position shown in FIG. 3.

When photographic film is used in the above described dispenser, it is of course important that the casing be made light-tight and that the exit gate be also light-tight.

It is understood that the above comprises one embodiment of this invention; those skilled in the art having the benefit of the description hereinabove given may effect numerous modifications thereto within the scope of this invention.

I claim:

1. An apparatus for separating and dispensing a single film sheet from a stack of film sheets loaded therein in a substantially vertical position, comprising (1) a casing;

(2) a film stack holding means within such casing for holding a stack of generally rectangular film sheets in a substantially vertical position, including;

(a) a pressure plate pressing against one side of said stack; a pivotally mounted base plate supporting the opposite side of said stock and spaced from said pressure plate, having an upper end hingedly mounted in said casing so as to permit the base plate to swing from the stack; and associated actuating means mounted on the base plate and the casing for urging the lower part of the base plate to swing alternately toward and away from the pressure plate;

(c) film stack support means defining a plane located below and extending between said pressure plate and said base plate for supporting said film stack along one lower edge thereof between said pressure and base plates:

(d) friction reducing means extending through said base plate which function to provide film support points along an upper end of said film stack, whereby a space is maintained between the upper end of said film stack and said base plate;

(e) at least one elongated combination film stack retainer/separator cam pivotedly mounted on said stack support means; and (f) spring means connected to said cam and stack support means urging an inner surface of said cam in contact with an outermost sheet of said film stack, (3) an upper film separator mounted within said casing above the upper edge of said stack and comprising a block having a separator slot located substantially in line with the aforesaid outermost film sheet of the film stack, sized to allow one, but not two, film sheets to be inserted therein simultaneously;

(4) at least one driven, rotatable, reversible, resilient first cam wheel mounted in said casing and extending through the base plate, and positioned so as to intermittently contact the aforesaid outermost film sheet at a point near the upper edge thereof, and means for selectively driving said first cam wheel; whereby when the cam wheel is driven through an arc clockwise it pushes said outermost film sheet into the separator slot in the upper film separator; and (5) a pair of drive wheels located in said casing below the film stack support means and forming a nip at a point below and behind the separator cam, and associated drive means for selectively driving said drive wheels; whereby when the cam wheel is rotated through an arc counterclockwise it pushes the aforesaid outermost sheet into the nip of the drive wheels, thereby separating said outermost film sheet from the film stack and dispensing it.

2. The apparatus of claim 1 which further comprises a cover for said casing, and a set of springs mounted on the pressure plate, whereby when the cover is closed the springs abut thereon to apply spring pressure to the film stack and bias it toward the base plate.

3. The apparatus of claim 2 wherein the springs are leaf springs.

4. The apparatus of claim 2 wherein the springs are conical springs.

5. The apparatus of claim 2 wherein the pressure plate is shaped with a recessed portion, defining ledges which function to apply pressure to the film stack along two narrow bands extending across the upper and lower ends of said stack.

6. The apparatus of claim 2 wherein the plane defined by the film stack support means (2)(*c*) is an inclined plane.

7. The apparatus of claims 2, 3, 4, 5 or 6 wherein the combination of the pressure plate and the inclined film stack support means functions to impart to an enclosed film stack a slightly curved posture.

8. The apparatus of claim 1 wherein said film stack retainer and separator (2) (*e*) comprises an elongated cam having an inner surface and an outer surface generally parallel to each other and connected by a bezel, the angle formed by the bezel and the aforesaid inner surface being an acute angle.

9. The apparatus of claim 8 wherein said acute angle is less than 65°.

10. The apparatus of claim 8 wherein said cam is mounted between a pair of upright supports on a shaft extending through said supports, and a pair of circular spacers is positioned between the cam and said supports, said spacers extending slightly beyond the inner cam surface so as to force a film sheet into contact with the forward end of this inner surface.

11. The apparatus of claim 8 wherein the bezel terminates in a sharp edge, the thickness of which does not exceed ¼ of the thickness of an individual film sheet.

12. The apparatus of claim 8 wherein the upper edge of the bezel is curved to prevent scratching the film.

13. The apparatus of claim 1 wherein the entry to the slot in upper film separator (3) is bevelled to a 15° angle relative to a line perpendicular to the slot, so as to facilitate film entry.

14. The apparatus of claim 1 wherein the cam wheel (4) is generally eliptical in shape.

* * * * *